United States Patent [19]

Bone

[11] 4,121,487

[45] * Oct. 24, 1978

[54] CONTINUOUSLY CONNECTED FASTENER ATTACHMENT STOCK

[75] Inventor: Arnold R. Bone, Needham, Mass.

[73] Assignee: Dennison Manufacturing Company, Framingham, Mass.

[ * ] Notice: The portion of the term of this patent subsequent to Aug. 2, 1994, has been disclaimed.

[21] Appl. No.: 812,875

[22] Filed: Jul. 5, 1977

Related U.S. Application Data

[60] Continuation-in-part of Ser. No. 594,736, Jul. 10, 1975, Pat. No. 4,039,078, which is a division of Ser. No. 347,678, Apr. 4, 1973, abandoned.

[51] Int. Cl.[2] ..... B65C 7/00; B25C 1/00

[52] U.S. Cl. ..... 83/23; 83/925 R; 24/150 FP; 206/343; 206/380; 206/820

[58] Field of Search ..... 83/925 R, 23; 227/94, 227/95; 206/343-347, 380, 820; 29/450; 24/150 FP

[56] References Cited

U.S. PATENT DOCUMENTS

| | | | |
|---|---|---|---|
| 3,103,666 | 9/1963 | Bone | 227/95 X |
| 3,243,092 | 3/1966 | Frasier | 227/94 |
| 3,734,375 | 5/1973 | Bone | 227/95 X |
| 3,759,435 | 9/1973 | Bone | 227/95 X |
| 3,948,128 | 4/1976 | Russell | 83/340 X |

*Primary Examiner*—J. M. Meister
*Attorney, Agent, or Firm*—George E. Kersey

[57] ABSTRACT

Continuously connected fastener attachment stock formed by elongated plastic side members with cross coupling links. One of the side member has successively connected cross bars with each cross bar connected to one of the cross links. The other side member has successively connected head pieces with each head piece connected to one of the cross links. The stock is proportioned to be fed as an entity to a position within a machine where individual fasteners are sparated from the stock, with each separate fastener including a head piece, a cross bar, and coupling link interconnecting the head piece with the cross bar. Each cross bar is configured for feeding through the bore of a slotted hollow needle.

10 Claims, 38 Drawing Figures

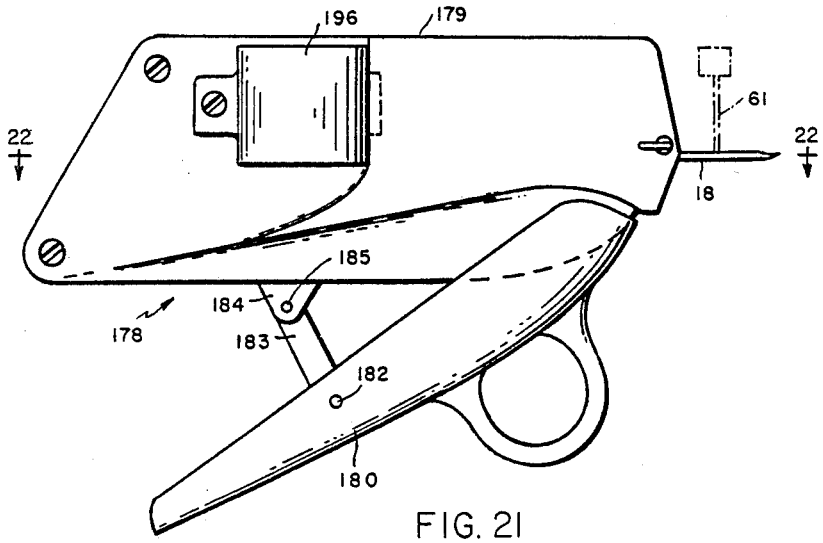
FIG. 21
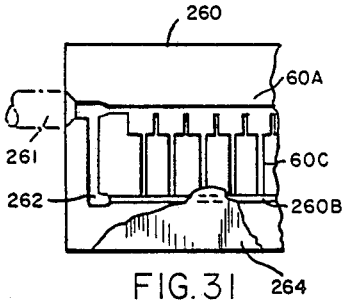
FIG. 31
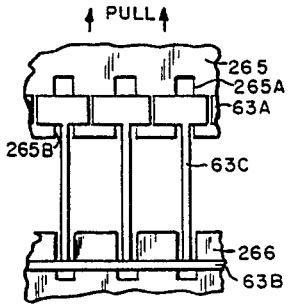
FIG. 32
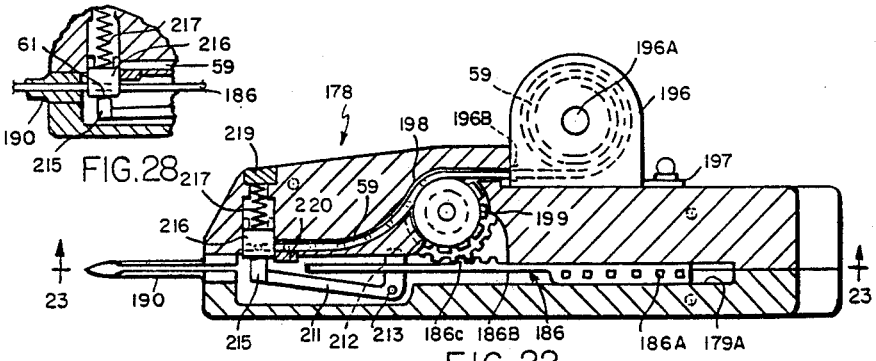
FIG. 28
FIG. 22
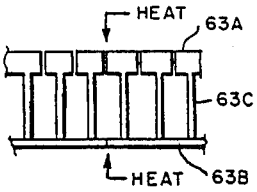
FIG. 34
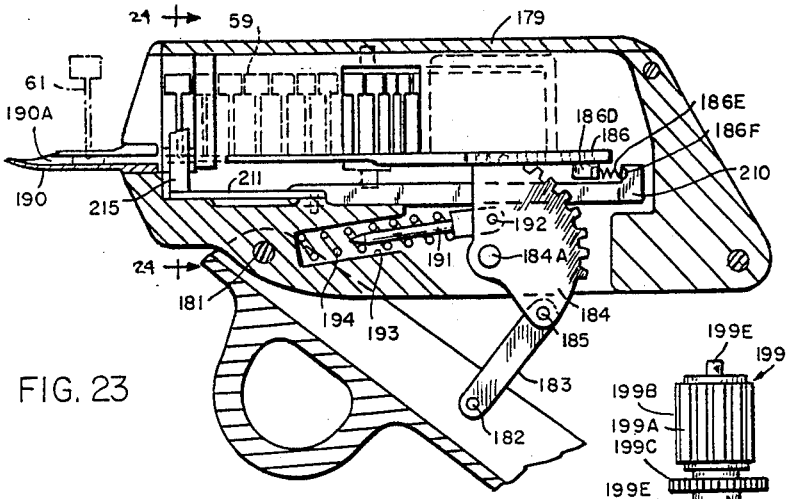
FIG. 23
FIG. 27
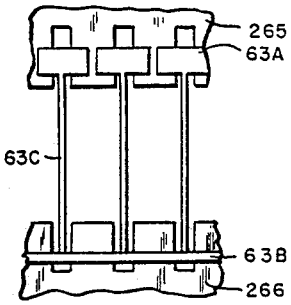
FIG. 33

CONTINUOUSLY CONNECTED FASTENER ATTACHMENT STOCK

BACKGROUND OF THE INVENTION

This is a continuation-in-part of Ser. No. 594,736, filed July 10, 1975 now U.S. Pat. No. 4,039,078, issued Aug. 2, 1977, which is in turn a division of Ser. No. 347,678 filed April 4, 1973 now abandoned.

The invention relates to continuously connected fastener stock and more particularly to fastener stock in which individual fasteners are separated from the continuously connected stock within a machine and dispensed from the machine through a slotted hollow needle.

In the fastener stock disclosed in U.S. Pat. Nos. 3,103,666; 3,444,597; and 3,470,834, individual fasteners, each formed by a head member cross coupled to a cross bar, are joined together at the cross bars by an orthogonally disposed runner bar. In addition in U.S. Pat. No. 3,733,657 the faces of adjoining head pieces of the fasteners are also joined together.

In all of the foregoing situations the stock form is a clip of finite length containing a limited number of fasteners. If the slip is too long it can create mechanical difficulties such as jamming in the dispensing of the individual fasteners. In addition, each time a clip is completely used the dispenser must be reloaded. When the comparatively short clips required for proper machine operation are used, there is resulting operator fatigue from frequent reloadings of clips.

The principal objection to the prior art fasteners, however, is that in production line operations it is important to dispense individual fasteners at a relatively uniform and continuous rate. Where fastener stock is provided in the form of clips, the reload and jam times can cause a significant curtailment in the rate of production.

In addition the runner bar is used only in joining the fasteners and represents waste material stock.

Accordingly, it is an object of the invention to provide fastener stock in which the loading and jamming times are significantly curtailed. A related object is to produce stock with many more fasteners than can be presently produced in clip form and presently accommodated by the associated dispensing device.

Another object of the invention is to reduce the occurrence of jams in the feeding and dispensing of individual fasteners from fastener stock. A related object of the invention is to provide stock without projecting cross bars that can cause jamming or projecting head portions that can also cause jamming.

Another object is to produce stock which can be easily stored and for which the problem of attachment entanglement is significantly reduced if not completely overcome.

SUMMARY OF THE INVENTION

In accomplishing the foregoing and related objects, the invention provides fastener attachment stock formed by two elongated plastic side members that have cross coupling links. The stock is proportioned to be fed as an entity to a position where individual fasteners are separated from the stock within a machine.

One of said side members is proportioned so that each separated fastener includes a bar formed from a portion of the side member and is configured for feeding through the bore of a slotted hollow needle.

The other side member is proportioned so that each separated fastener includes a head member formed from a portion of the side member. Each cross link is foldable towards the associated end bar that is feedable through the hollow needle.

In accordance with one aspect of the invention, the cross links are uniformly spaced between the side members, which are of different construction.

In accordance with another aspect of the invention the side members have a circular cross section, which is less than that of either side member.

In accordance with a further aspect of the invention the cross section of the cross links can be greater than that of either or both side members. The cross links advantageously have their molecules reoriented by stretching to strengthen them with respect to at least one of the side members.

According to yet another aspect of the invention the fastener attachment is formed by molding. The head members are desirably joined by a connecting filament which is narrower than the members and the cross bars are also joined by a connecting filament which is narrower than that of cross bars.

Individual fasteners can be provided from fastener stock by feeding the stock formed by two elongated and cross coupled plastic side members to a sever position and separating an individual fastener from the stock to provide a cross link with an end bar formed from a portion of one of the side members and an opposite end member formed from a portion of the other side member. The fastener thus formed has its end bar fed through the bore of a hollow needle having a longitudinal slot for the passage of the associated cross link.

DESCRIPTION OF THE DRAWINGS

FIG. 21 is a side view of a hand operable device for forming fasteners from stock and dispensing the individual fasteners;

FIG. 22 is a sectional view taken along lines 22—22 of FIG. 21;

FIG. 23 is a sectional view taken along lines 23—23 of FIG. 22;

FIG. 27 is a side view of a feed wheel for the hand operated apparatus of FIGS. 22 and 23;

FIGS. 31–33 illustrate another method of forming stock according to the invention and then stretching it to strengthen its cross links; and FIG. 34 illustrates joinder of short lengths of stock to form overall lengths.

DETAILED DESCRIPTION

Figure 1:
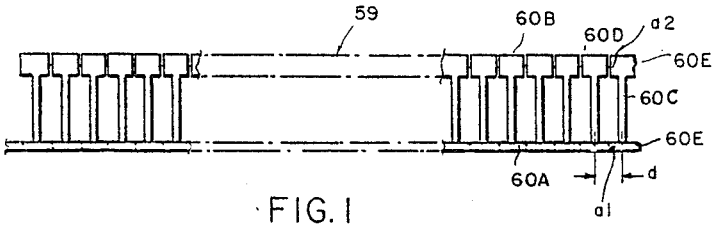
FIG. 1 is a plan view of a length of continuous fastener stock in accordance with the invention.
Figures 2, 3:
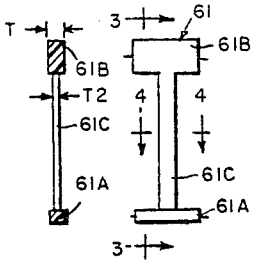
FIG. 2 is a front view of an individual fastener formed from the stock of FIG. 1.
FIGS. 3 and 4 are sectional view of the fastener of FIG. 2 taken along lines 3—3 and 4—4.

Turning to the drawings, one type of fastener stock in accordance with the invention is illustrated in FIGS. 1–3. The stock 59 is formed by two elongated and continuously connected side members 60A and 60B, which are cross-coupled by plastic links 60C. The side member 60A is in the form of successively connected cross bars which are joined to one another at approximately the central axis of the continuous side member 60A. The desired connection between adjoined cross bars can be formed by opposite incisions on the member 60A to produce in effect a thin filamentary extension between the adjoined cross bars. A similar filamentary extension between adjacent head pieces is included in the continuous side member 60B.

The stock 59 is preferably of a plastic material. Most preferably the plastic material is flexible at least in part and is also sufficiently stiff in at least a portion thereof so that a portion thereof may easily be pushed through a needle slot as will be shown later in this disclosure.

Additionally, in certain applications involving the coupling of buttons, it is highly desirable that the stock also be resilient. The plastic material forming the side members is also preferably of the type so that it may easily be separated or divided by rupturing, severing, cutting or etc., as shown herein to provide a plurality of fastener attachment devices that it separates upon being fed into a dispensing apparatus and thus causes jamming of the apparatus.

As used herein and for convenience it is intended that the term plastic be given its broadest meaning as defining any flexible plastic or flexible polymer such as elastomeric materials thermoplastics and flexible thermosetting resins which those skilled in the art will recognize as useful for the purpose disclosed herein.

Materials which may be used herein are conventional plastics such as nylon, polyurethane, polyethylene, polypropylene polyvinly chloride, etc. Other plastics suitable for this purpose will be apparent to those skilled in the art. Reference may also be made to U.S. Pat. Nos. 3,444,597, 3,103,66 and 3,470,834 among others for a further teaching of plastic materials which may be useful herein. It should be understood that combinations of plastic materials may be used as the stock.

In its preferred construction the two side members are preferably parallel to each other and the cross links are also preferably parallel to each other. In addition, each of the cross links are preferably spaced an equidistance "*d*" apart so they may easily be fed into a fastener attaching apparatus in a preset sequence necessary for the regular timed operation of most machines.

Figure 4:
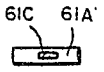

As shown in FIG. 1 the side members also preferably extend beyond the first cross link at 60 so that the first separation of a fastener attachment device shown in FIGS. 2–4 will from the beginning be useful for its intended purpose.

The cross links or the side members of the stock may also be stretched as disclosed in U.S. Pat. Nos. 3,444,597 and 3,470,834 to strengthen plastic materials such as nylon.

The stock 59 may be fabricated by punching or forming apertures 60D in an extruded sheet of plastic as will be seen later with reference to FIGS. 29 and 30.

In FIGS. 2–4 there is disclosed an individual fastener resulting from the separation of one device from the stock e.g., by cutting the side members 60A and 60B between the first and second cross links at $a^1$ and $a^2$ in FIG. 1.

The resulting fastener attachment device comprises two end bars 61A and 61B preferably of the same length coupled together by a filament member 61C. In this configuration the cross section of the end bar is rectangular as is the cross section of the filament member 61C.

Preferably the filament member (as well as the cross link) has a thickness $T^1$ which is smaller than the thickness $T^2$ of the end bar (side member) when viewed in the cross sectional view (see FIG. 3) to insure secure travel through a needle as will be described herein.

Figure 5:
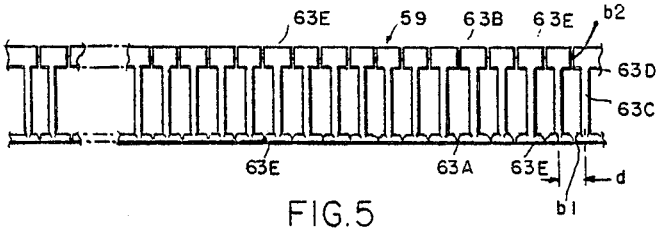
FIG. 5 is a plan view of an alternate length of continuous fastener device stock formed in accordance with the invention.
Figures 6, 9:
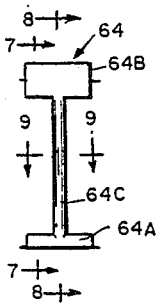
FIG. 6 is a front view of an individual fastener formed from the stock of FIG. 5.
FIGS. 7, 8 and 9 are sectional views of the fastener of FIG. 6 taken along lines 7—7, 8—8 and 9—9.
Figures 7, 8:
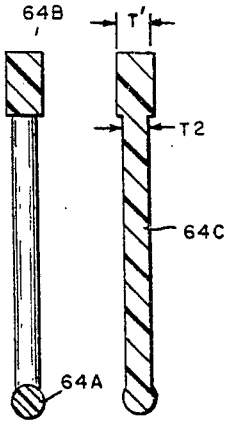

A further embodiment of the fastener stock is shown in FIGS. 5–8. By contrast with the continuously connected 60A of FIG. 1, the corresponding side member in FIG. 5 has a circular cross section, as indicated in FIG. 7 except at the end of each cross bar where there is a thin filamentary connection near the base of the side member as further illustrated in FIG. 6 at position *b*-1 of FIG. 5. The filamentary connection in the position *b*-2 for the adjoining head pieces of the upper side member, corresponding to the side member 60B of FIG. 1 is at position *b*-2.

In FIG. 5 the stock is preferably made by molding, for example as shown in FIG. 31, in relatively small sections and then both welded together as shown in FIG. 33. In particular, the stock also (shown as 59) in FIG. 5 comprises side members 63A and 63B and cross links 63C separated from each other by apertures 63D. The stock is formed by welding together side members of molded sections at point 63D. In this manner the continuous, undivided, elongated side members 63A and 63B are formed. FIGS. 7–9 illustrate a fastener attachment device separated from the stock of FIG. 5 by severing the side members at points $b^1$ and $b^2$.

The construction of the stock of FIG. 5 is such that the end bars 64A and 64B are round in cross section as is the filament 64.

More particularly, it is preferred that the cross link 63 be molded with a smaller diameter or thickness $T^2$ than the diameter or thickness $J^1$ of the side members 63A and 63B to insure that the resulting attachment device 64 will be securely retained within the needle of the fastener attachment apparatus as will be described.

It should also be understood that if desired the thickness of the filament 64C may be greater than or equal to the thickness of the end bars 64A or 64B depending upon the application, although for dispensing through a needle as disclosed herein so as to insure reliable dispensing the thickness of the cross links should be less than the thickness of the side members so that the side member will securely ride in the central wider portion of the needle slot with the cross link positioned in the narrow portion of the needle slot.

It should also be understood that the side members and the cross links as well as the resulting end bar and filament may take many shapes, as for example the filament may be round and the end bars rectangular or vice versa.

Figure 10:
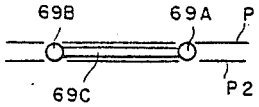
FIG. 10 is a side view showing stock in accordance with the invention confined between two parallel planes.

Reference should briefly be made to FIG. 10 which illustrates the fastener stock 59 having round side members 69A and 69B and rectangular cross links 69C. FIG. 10 illustrates in a front view, stock 59 to illustrate that the stock is planar in construction and that in most preferred construction the stock is entirely positionable between two parallel planes $P_1$ and $P_2$ defined by the top and bottom of the side members 69A and 69B. It should be understood that the side members or cross links may take various other shapes as oval, triangular, octagonal, etc., and in addition it should be understood that side members may be of different dimensions from each other to provide a tab such as shown in U.S. Pat. No. 3,444,597.

In some cases to facilitate machine separation of devices from the stock if tough to separate materials are used, the side members may be formed with weakened areas.

Figure 11:
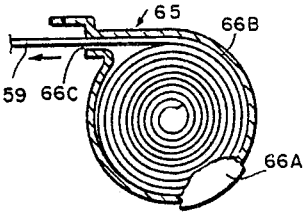
FIGS. 11 and 12 are diagrams illustrating alternate ways of storing continuous attachment stock in a canister.
Figure 12:
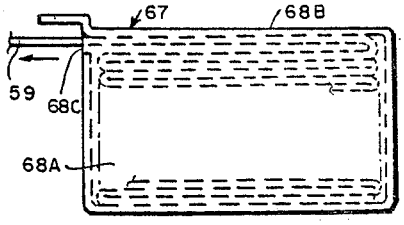
Figure 13:
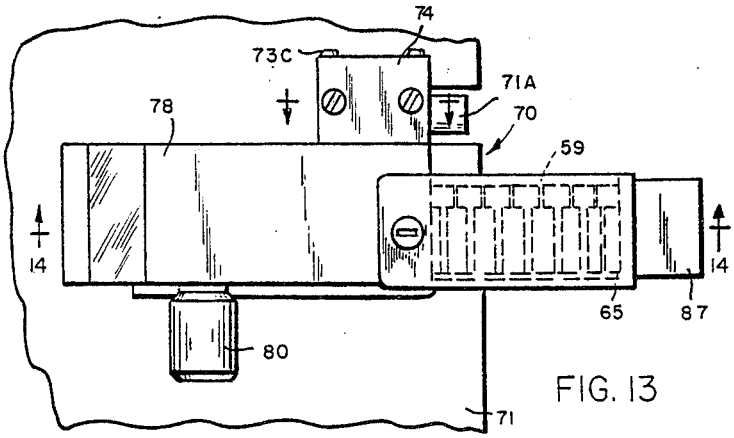
FIG. 13 is a top view of a device for forming and dispersing the individual fasteners of FIGS. 2–4 and 6–9 from the stock of FIGS. 1, 5 and 10.
Figure 15:
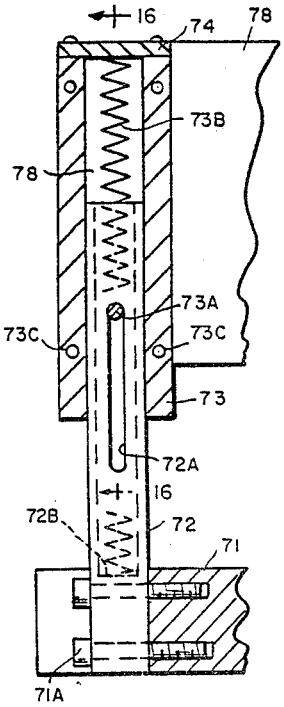
FIG. 15 is a sectional view taken along lines 15—15 in FIG. 14.

In FIGS. 11 and 12 there is shown a container, can or canister in two convenient shapes for storing the fastener attachment stock of this disclosure. FIG. 11 illustrates at 65 a round canister for storing fastener attachment stock 59 in a roll as shown.

For use, the stock may first be rolled up and placed in the canister 65 by removing the press fit cover 66A from the canister body 66B and inserting the roll with a portion of the stock being passed through a feed opening 66C.

The stock 59 will travel as shown by the arrow when pulled from the canister. In FIG. 12 there is shown a box like container 67 in which fastener attachment stock folded back and forth over itself as shown may be stored. The container 67 comprises a removable cover 68A which is coupled to the main storage portion 68B thereof. The cover 68A is removed for loading of the stock after the stock is folded e.g., by removing screws (not shown) holding it in place, and is then replaced to hold the fan folded stock in place. The stock is withdrawn from the container 67 via a slot or opening 68C and is pulled in the direction as shown by the arrow to feed a fastener attachment apparatus.

In order to show the manner in which the new and improved fastener attachment stock may be used, there is disclosed in FIGS. 13–48 various new and improved fastener attachment apparatus constructions as well as some of the uses to which the fastener attachment devices provided from the stock 59 may be applied.

In FIGS. 13–16 there is illustrated an apparatus for separating the stock into individual fasteners and inserting an end bar of each fastener into a slotted hollow needle to be dispensed. For convenience the fasteners are indicated generally by the reference numeral 61.

Figure 25:
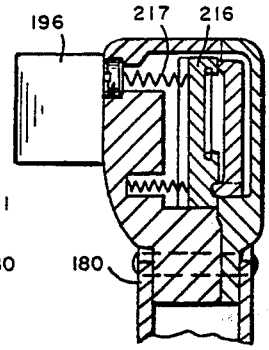
FIG. 25 is a view similar to that of FIG. 24 after a fastener has been formed from the stock.

The needle dispensing apparatus 70 includes a base 71 which supports an upright member 72 by bolts 71A (FIG. 25). The upright 72 is partially hollow and includes a motion limit slot 72A.

The top portion of the upright 72 is slidable within housing walls or members 73 (3 in number) capped with a top member 74. Supported by one of the three members 73 is a motion limit screw 73A positioned within the slot 72A. The members 73 are in turn coupled to a main body 78 by bolts 73C which support the needles and the other operating parts of the apparatus. Within the member 72 there is provided a resilient biasing means such as a spring 73B which extends into the area between the housing walls 73. The top of the spring is positioned against the top member 74 and the lower part of the spring rests on a shelf 72B in the interior of the member 72. The spring 73B acts to maintain the body 78 in a raised position as shown in FIGS. 14 and 21 while the pin 73A limits the downward movement of the body 78 against the spring 73B when the body is manually forced downward.

The body 78 includes a feed slot 79 to permit the flow of stock 59 from the container 65 coupled by a 65D to the body as shown. The stock 59 upon entering the body is positioned on means such as a wheel 82 for feeding the stock into the apparatus in order to separate the stock 59 into the devices 61.

The wheel 82 has a plurality of raised portions 82A which fit into the apertures 60D of the stock 59 and carries the cross links in open ended grooves 82B (see FIGS. 14 and 14A) with the side members on either side of the projection 82A.

The wheel 82 is mounted on a shaft 81 and is keyed thereto by a key 81A for rotation therewith. The shaft 81 is supported for rotation by the side wall 78A of the body in a conventional manner (See FIG. 14A) and coupled to a knob 80 for advancing it. Wheel 82 motion is retarded by a spring detent 83.

The stock is forced by the feed means 82A through a guide slot 78B into a horizontal slot 78C (open in parts) formed in the body 78. Positioned within the slot 78C is a member 87 which acts in combination with member 90 to separate devices 61 from the stock 59 after the stock 59 is urged and positioned against the bottom of the slot 78C.

The means 87 also positions the separated devices 61 (see FIG. 14) at a location to be dispensed via needles 91. The member or carrier 87 is more clearly shown in FIGS. 15 and 16 and includes a guide and retaining slot portion 87A into which the stock 59 is initially fed. The member 87 is manually urged to the left of FIG. 14 to separate the stock 59 at points $a^1$–$a^2$ or at other points along the side members 60A and 60B to provide the fastener attachment device 61.

The member 87 or the member 90 or both may also carry knives to effect separation of the stock 59 into devices. Also a separate moving knife apart from member 87 may also be used if desired.

All of the above is intended to be included in the definition of means for separating or dividing the stock 59 into a plurality of devices 61.

The movement of the member 87 is limited by a bolt 89 positioned in a cutout 88 formed in the body 78. In order to drive the end bars of the device 61 through the needles 91 there is provided an end bar pusher mechanism comprising a top member 101 supporting a member 103 having a slot 102A for supporting two needle plungers 103.

Figure 17:
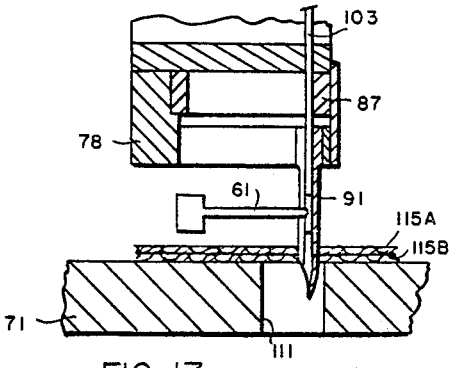
FIG. 17 is a sectional showing a plunger and needle for inserting one end bar of a fastener through layers of material.
Figure 18:
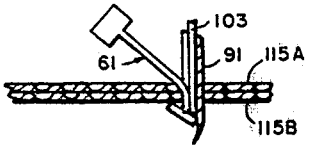
FIG. 18 illustrates the fastener of FIG. 17 popping from the needle in FIG. 17.

The member 102 is slidable in a guide slot 78B formed in the body 78 and is held in place within the slot by a plate 93 coupled to the body 78 by screws as shown in FIG. 17.

Figure 14A:
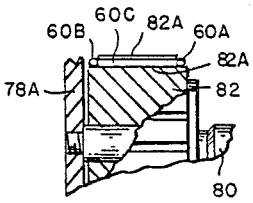
FIG. 14A is a partial sectional view of the device of FIG. 14 along the line 14A—14A.
Figure 14B:
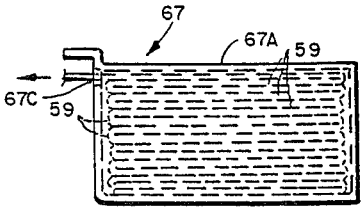
FIG. 14B is a diagram illustrating another stock container for the device of FIG. 14.
Figure 14:
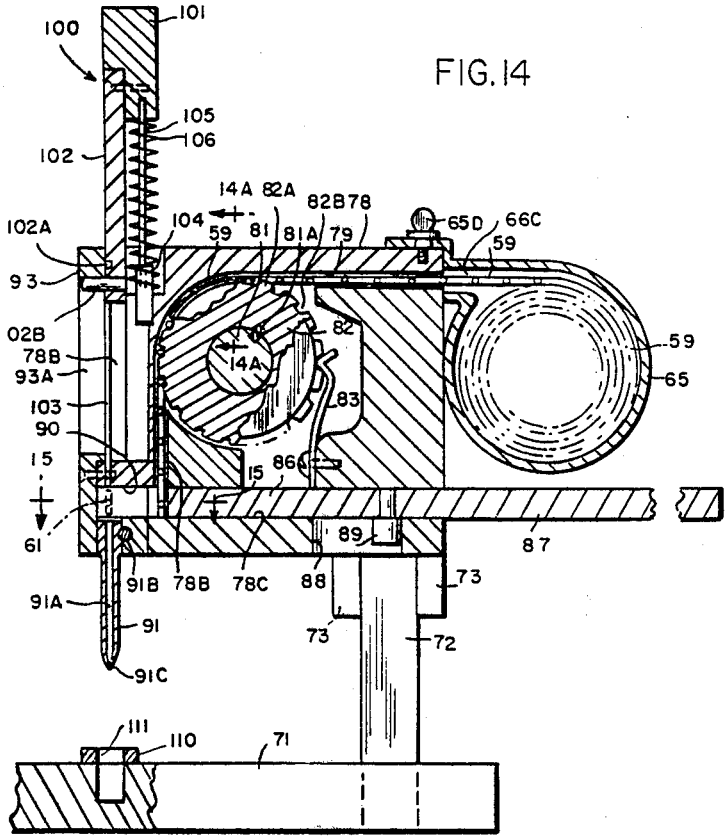
FIG. 14 is a sectional view of the device of FIG. 13 along the lines 14—14.
Figure 16:
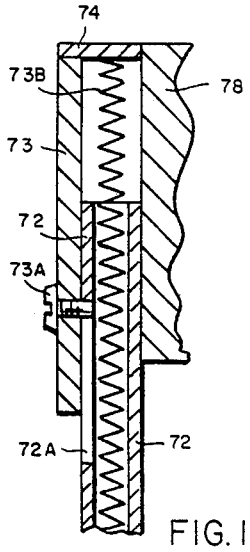
FIG. 16 is a sectional view taken along lines 16—16 in FIG. 15.

The plate 93 has a limit slot 93A formed therein in which there is positioned a limit pin 102B supported by member 102. The members 101, 102 and the pushers 103 (coupled to member 102) are urged upwardly by a spring 106 supported by a rod 105 slidably mounted in a member 104 having a bore (shown dotted). In this manner the pushers or plungers 103 are retained above the mouth of the needles, At 110 there is a raised platform having a bore 111 through which the needles may extend. Briefly, the operation of the apparatus shown in FIG. 14 is as follows:

(1) stock 59 is fed into the body 78 from the container or canister 65 containing a roll or coil of the stock or from the canister 67 (see FIG. 14B) containing the stock in a fan fold configuration and is positioned on the wheel 82 as shown in FIG. 14A for processing in the apparatus.

Figure 19:
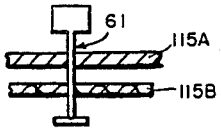
FIG. 19 illustrates the fastener of FIGS. 17 and 18 holding two layers of material together.

(2) the knob 80 is rotated to bring the stock side member ends 60E (see FIG. 1) against the bottom of slot 78C and through the guide slot 87A in the member 87;

(3) the member 87 is then pushed to the left of FIG. 14 to divide or separate a fastener attachment device e.g., H shaped by forcing the side members 60A and 60B of the stock 59 against an edge surface of member 90. This in effect results in a severing, rupturing or cutting of the side members 60A and 60B to form a fastener attachment device 61 depending upon the edge configuration and sharpness;

(4) thereafter the carrier member 87 now holding the device 61 is moved to the left of FIG. 14 to the point where the device end bars 61A and 61B are positioned above the slots 90A of the two needles 91. The device 61 is preferably somewhat wedged or tightly fits into the slot 86A so that it moves easily with the carrier member 86. The needles as shown are held in place by locking means 91B and each having a slot 91A to accommodate the end bar thickness and a narrower portion 91C to permit the narrower thickness filament portion 61C to extend therethrough. In this manner the fastener attachment device end bars 61A and 61B are securely held within the needles when the end bars travel therethrough;

(5) assuming now that two pieces of material 115A and 115B are positioned one on top of the other on the platform 110, the body 78 is then forced downwardly to drive the needle tips 91C through the material and into the bores 111 and 70A;

(6) at this time the member 101 is urged downwardly to force the plungers 103 to push the device 61 end bars 61A and 61B respectively through (preferably simultaneously) the needle slots 91A with the filament 61C extending between the needles 91;

(7) when the plungers 103 extend downwardly as shown to the point shown in FIG. 19, the end bars 61A and 61B are urged or pop out of needle wide cutaway portion 91E thereby providing for a coupling of the layers of material together as shown in FIG. 20. The plastic material used for the device 61 preferably has enough return in it to cause it to assume the proper shape.

It should be understood that the sequence of operations described herein may be modified without departing from the invention. For example, the body 78 may first be forced downwardly to pierce the material with the needles, the carrier member 87 may then be moved to divide the stock 59 and position the device 61 and thereafter the pushers 103 may be forced downwardly.

Figure 20B:
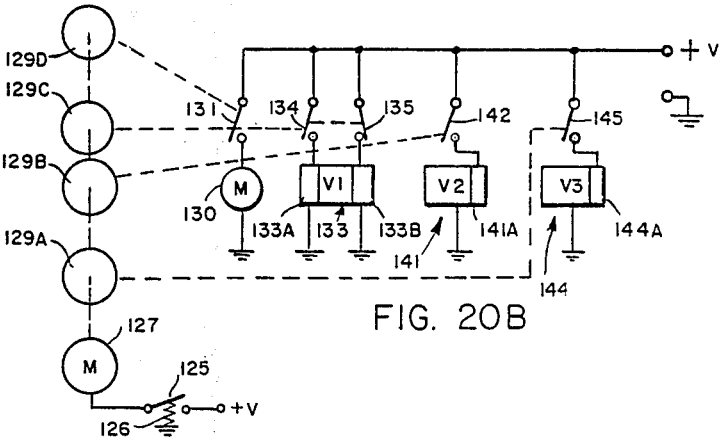
FIG. 20B is a block diagram of circuitry for operating the apparatus of FIG. 20A.
Figure 20A:
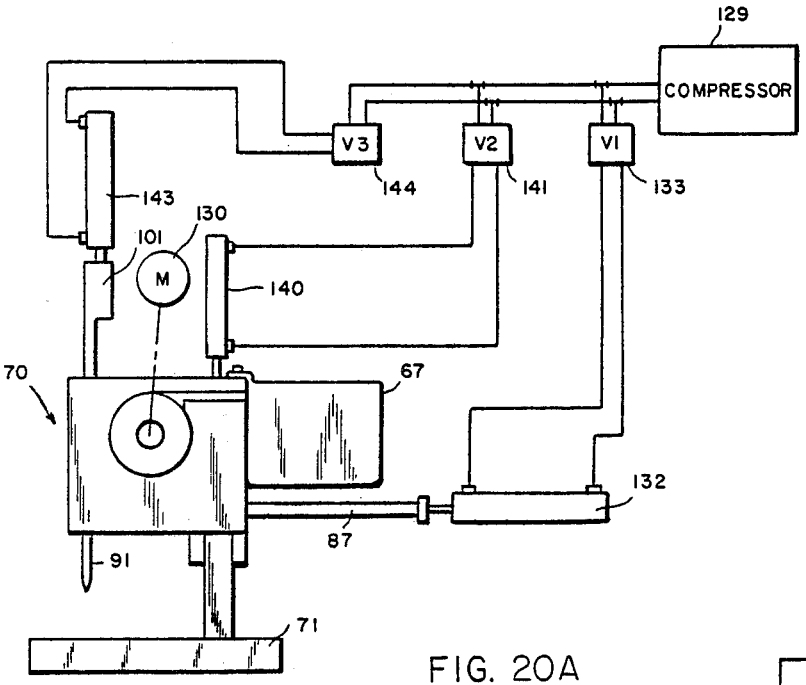
FIG. 20A is a diagram of a powered system for controlling apparatus in accordance with the invention.

In FIGS. 20A and 20B there is schematically shown, an automated implementation for the apparatus shown in FIG. 14. In order to operate the various parts of the machine, that is to feed the stock by rotating the wheel 82 the carrier moves member 87 to separate the device 61 from the stock and position them for dispensing through the needles 91, move the machine body 78 to do that the needles 91 pierce the material, and drive the plungers 103 (via member 101) through the needles to force the device end bars 61A and 61B therethrough, there are provided a plurality of fixed in place fluid operated cylinders 132, 140, and 143 having piston rods 132A, 140A, and 148A and a stepping motor 130 mounted to the apparatus 70.

In order to provide fluid e.g., compressed air or gas (oil or hydraulic fluid may also be used) there is provided a compressor pump 129. The passage of fluid back and forth into the cylinders is controlled by solenoid control valves 133, 141 and 144.

Valve 133 is shown in block and may be a four way two solenoid valve (the solenoids are as shown in 133A and 133B) such as shown in U.S. Pat. No. 3,306,144 and the valves 141 and 144 are also shown in block may be the three way valve one solenoid and spring return also shown in U.S. Pat. No. 3,306,144.

In order to control the solenoids 133A, 133B, 141A and 144A of the valves shown in FIG. 20A, there is diagrammatically shown at 125 a foot pedal as may be used in the garment industry having a spring return 126.

The motor drives a shaft 128 having a plurality of shaped timing cams 129A – 129B supported thereon for rotation therewith.

The cams are used to operate cam followers (shown dotted) to control the opening and closing of switches 131, 142, 145 and ganged switches 134 and 135.

By actuation of the motor 127, the aforementioned switches coupled to solenoids 133A, 133B, 141A and 144A of valves 133, 141 and 144 are sequentially controlled to control machine operation as heretofore described. In addition, switch 131 will provide a signal to step the stepping motor 130 to feed the fastener attachment stock.

Reference should now be had to FIGS. 21–28 which illustrate a hand operatable fastener attachment apparatus 178 using the principles of the apparatus shown in FIGS. 13–24 to dispense a fastener attachment device 61 separated from the stock 59.

The apparatus 178 comprises a body 179 to which there is pivotly attached a handle 180 at point 181. The handle drives a link 183 coupled thereto at 182 to rock back and forth a gear segment 184 pivotly coupled to the link at 185 and to the body at 184A.

The gear segment is urged to the right of FIG. 23 by a spring 194 positioned in a body cavity 193 which forces a pin like member 191 pivotly coupled at 192 to the gear segment 184. The gear segment 184 drives a plunger 186 by gear teeth positioned in cutouts 186A.

For a further description of this type of drive system reference may be had to my U.S. Patent application Ser. No. 169,413 filed on Aug. 5, 1971.

The stock 59 is stored in a container 196 in a rolled up configuration about a pin 196A container being detachable from the body 174 via screw 197. The stock 59 is passed through a container opening 196B and then threaded through slot 198 over feed wheel 199 of the type as previously disclosed.

The feed wheel 199 comprises ridges 199A between cavities 199B to support the stock 59. The ridges fit within the aperture 60D with the links 60C and side members 60A and 60B positioned thereabout as previously disclosed with reference to FIG. 13.

The wheel portions are supported by a conventional one way roller or clutch mechanism so that it will rotate to feed stock in one direction. A one way roller mechanism may be purchased from the Torrington Company of Connecticut under the designation Torrington's "Drawn Cup Overrunning Roller Clutch" and modified as shown herein, and another type of one way roller is also disclosed in U.S. Pat. No. 3,652,001.

The one way roller is driven via gear 199C coupled thereto (see FIG. 26) which is in turn driven by gear teeth 186C of member 186. The feed wheel is mounted on shaft members 199E supported by bores formed in the body and accessible by removing the top of the body.

Figure 24:
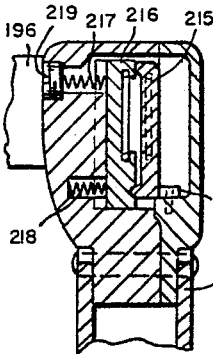
FIG. 24 is a sectional view taken along lines 24—24 of FIG. 23.

The stock 59 is fed into a carrier member 216 (of the type 87 previously disclosed) which is urged to the right of FIGS. 24 and 25 by springs 217 and 218, the spring 217 being supported at its rear against plug 219.

Figure 28:
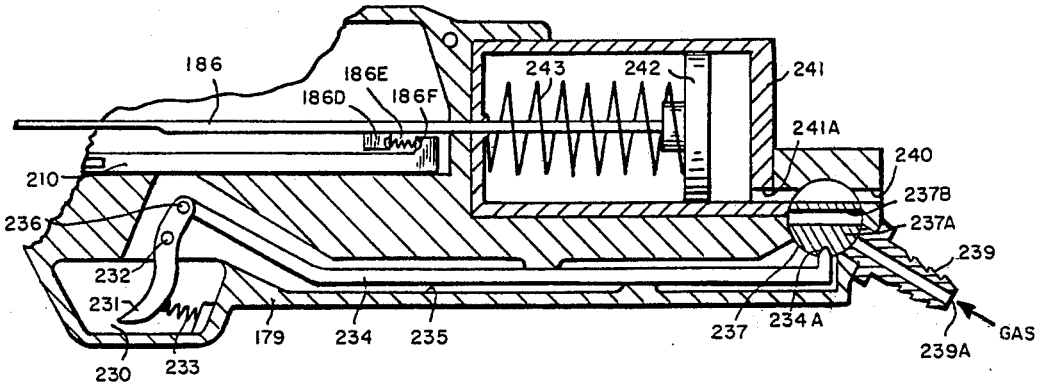
FIG. 28 is a sectional view of a modification of the apparatus of FIGS. 21 through 23 for powered operation.

The stock is divided or separated 61 into fastener attachment devices by the engagement of the side members of the stock against member 220 as shown in FIGS. 42 and 28 as the carrier member moves under spring pressure from the position shown in FIG. 24 to the position shown in FIG. 25. FIGS. 25 and 27 illustrate the carrier member holding one fastener attachment device 61 in position for it to be pushed through the slot 190A of needle 190 by the plunger member 186.

Figure 26:
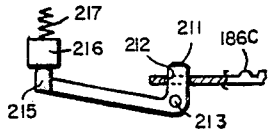
FIG. 26 is a diagrammatic view showing parts for dividing the stock into individual fasteners.

In order to return the carrier member after the dispensing of a fastener attachment device 61, there is provided a pivotal member 211 which extends through a cutout 212 in the slidable member 210 and is pivotly supported by pin 213 (see FIGS. 23 and 26).

On the advance stroke of member 186, the member 210 is free to move forward therewith after a spring 186E supported by member cutouts 186D and 186F fully expands. Thus under the pressure of springs 217 and 218 the member 216 moves to the right of FIG. 43 to the position shown in FIGS. 44 and 47 and thus rotates member 211 about pin 213 which at this time is free to rotate due to the advance of member 186.

Upon the opening of handle 180, the member 210 is driven rearwardly by member 186 to rotate member 211 clockwise (see FIG. 22) and return the carrier member 216 to the position shown in FIG. 43 where it can now receive the stock 59.

In this device the stock 59 is fed into the carrier member 216 on the return stroke as member 186 begins to compress spring 186E and the gear teeth 186C engage the gear teeth of gear 199C.

In summary, the operation of the hand actuable fastener attachment apparatus of FIGS. 21–27 is as follows:

(a) stock is fed into the carrier member 216;

(b) the handle 180 is compressed causing the member 186 to move forward thus permitting the separating of one fastener attachment device 61 from the stock and the positioning of the device to be pushed through the needle 190;

(c) the member 186 then continues to move forward to engaged an end bar of the fastener attachment device 61 and push it through the needle;

(d) on the return stroke and under the pressure of spring 194 the member 186 is withdrawn from the needle causing the return of the carrier member 216 and then the feeding of the stock 59 into carrier member 216 to ready the apparatus for its next use.

Reference should now be had to FIG. 28 which illustrates a powered (e.g., fluid or electric powered) version of the apparatus of FIGS. 21–27. All elements are the same except that the member 186 is driven by a modified version fluid operated system as shown in my U.S. Pat. No. 3,659,769.

In this FIG. fluid such as compressed air or gas is controllably fed into a cylinder 241 by a trigger 231 operating a valve 237. The trigger is pivotly mounted at 232 to the body and is positioned in a finger hole 230. Pulling the finger 231 backwards against return spring 233 causes the slidable rod 234 pivotly coupled at 230 to the trigger 231 to move to the right of FIG. 28. Finger 234A of the rod 234 thus rotates the valve member 273 having solid portions 237A positioned for rotation in a cavity formed within the body and a passageway 237 extending through a portion thereof as in FIG. 11 of U.S. Pat. No. 3,659,769.

In its rotated position gas shown by the arrow travels through a bore 239A of a plug 239 thence through the passageways 237B and 241A to move the piston 242 to the left of FIG. 28.

In this manner the piston 242 compresses the return spring 243 to drive the member 186 to the left of FIG. 28. Upon release of the trigger 231, the member 234 moves left rotating the valve member 237 to the position shown in FIG. 48 to exhaust the gas from cylinder through port 240. The return spring 243 then returns the piston 242 and the member 186 coupled thereto to provide the functions previously described with reference to FIGS. 21–27.

Figure 29:
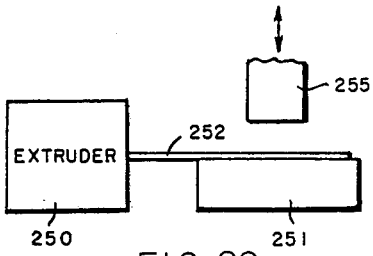
FIGS. 29 and 30 illustrate a method of forming stock according to the invention.
Figure 30:
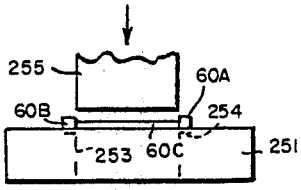

At this time reference should be had to FIGS. 29–34 which illustrate various methods for fabricating the stock 59. FIGS. 29 and 30 disclose an inexpensive and convenient manner for fabricating the stock according to the disclosure. The stock 59 is formed by providing an extruded continuous strip of plastic 252 from an extruder in the configuration shown in FIG. 50 and then punching out or forming apertures by applying a force to a punching member 255 to move it up and down to form the apertures (leaving the side members and cross links) as the strip moves in a direction to the right of FIG. 49 while the strip 252 passes over the table 251. The punched out portions of the strip pass through an opening 253 in the table. Stock such as shown in FIG. 1 is conveniently formed in this manner although obviously various other shaped stock may also be formed.

In FIG. 31 there is shown a method of molding the stock in a mold 260 by forcing into the mold plastic under pressure into channels 264A formed in the mold top 262 and bottom 264 and then cooling or curing depending upon the plastic used. Stock 59 having side members 60A and 60B with cross links 60C is thus formable.

Smaller sections formed in this manner may be joined together by applying heat e.g., from a laser, ultrasonic means and other conventional heating devices as shown in FIG. 34 to butt weld the side members 63A and 63B of each section together, said side members supporting the cross links 63C.

In FIGS. 32 and 33 there is illustrated the stretching of the cross links 63C of the stock by puller members 265 and 266 having slots 265A and 265B to hold the side members and cross links during the stretching operation to strengthen as well as elongate stock made from materials such as nylon exhibiting a crystalline structure and which will be strengthened by stretching. Conveniently such crystalline structure materials may be heated during stretching to facilitate stretching.

It will thus be seen that the purposes set forth above for this invention have been efficiently attained and since certain changes may be made in carrying out the methods and in the constructions set forth, it is intended that all matter contained in the following description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. Fastener attachment stock comprising two continuous and elongated plastic side members that have cross coupling links;

said stock being proportioned to be fed as a unit to a position where individual fasteners are separated therefrom within a machine;

one of said side members being proportioned so that each separated fastener includes a bar formed from a portion of the side member and is configured for feeding through the bore of a slotted hollow needle;

the other of said side members being proportioned so that each separated fastener includes a head member formed from a portion of the side member;

and each cross link being foldable towards the associated end bar that is feedable through said hollow needle.

2. Fastener stock as defined in claim 1 wherein said cross links are uniformly spaced between said side members.

3. Fastener stock as defined in claim 1 wherein said side members are of identical construction.

4. Fastener stock as defined in claim 1 wherein said side members have a circular cross section.

5. Fastener stock as defined in claim 1 wherein the cross section of said cross links is less than that of said side members.

6. Fastener stock as defined in claim 1 wherein the cross section of said cross links is greater than that of said side members.

7. Fastener attachment stock as defined in claim 1 wherein the cross links have their molecules reoriented by stretching to strengthen them with respect to at least one of said side members.

8. Fastener attachment stock as defined in claim 1 wherein said stock is formed by molding.

9. Fastener attachment stock as defined in claim 1 wherein said head members are joined by a connecting filament which is narrower than said head members and the end bars are joined by a connecting filament which is narrower than said cross bars.

10. The method of providing individual fasteners from fastener stock comprising the steps of (a) Feeding fastener stock formed by two continuous and elongated plastic side members that are cross coupled by a plurality of cross links;

(b) Separating an individual fastener from the fastener stock to provide a cross link with one end bar formed from a portion of one of said side members and an opposite end bar from a portion of the other of said side members;

(c) Feeding at least one of the end bars through the bore of a hollow needle having a longitudinal slot for the passage of the associated cross link.

* * * * *